United States Patent [19]

Roberts

[11] Patent Number: 4,576,375

[45] Date of Patent: Mar. 18, 1986

[54] FLOTATION TRAMPOLINE

[76] Inventor: Donald K. Roberts, 488 W. 2000 South Building 4, Orem, Utah 84057

[21] Appl. No.: 575,464

[22] Filed: Jan. 30, 1984

[51] Int. Cl.[4] ..... A63B 5/00; A63G 31/00

[52] U.S. Cl. ..... 272/65; 272/1 B

[58] Field of Search ..... 272/65, 66, 1 B; 441/37, 40, 66, 131; 280/12 B

[56] References Cited

U.S. PATENT DOCUMENTS

| | | | |
|---|---|---|---|
| 1,456,168 | 5/1923 | Witmer et al. | 272/65 |
| 3,021,536 | 2/1962 | Haggerty | 441/40 |
| 3,080,584 | 3/1963 | Brown | 280/12 B |
| 3,581,328 | 6/1971 | Smith | 280/12 B |
| 3,653,084 | 4/1972 | Hartman | 441/40 |
| 4,037,834 | 7/1977 | Oaks | 272/65 |
| 4,331,329 | 5/1982 | Mirkovich et al. | 272/65 |

FOREIGN PATENT DOCUMENTS

| | | | |
|---|---|---|---|
| 26102 | 6/1920 | Denmark | 441/40 |

*Primary Examiner*—Richard J. Apley
*Assistant Examiner*—S. R. Crow
*Attorney, Agent, or Firm*—Calvin E. Thorpe; Vaughn W. North; M. Wayne Western

[57] ABSTRACT

A flotation trampoline adapted for use on a body of water comprising a non-elastic, collapsable encasement having a symmetrical configuration. The base cover is attached to a perimeter on the lower, interior tube surface and is adapted to seal off a rapid air or water flow through the tube opening to thereby create a substantially closed volume between the base cover, lower interior tube surface and the water surface upon which the tube is placed. A resilient cover is attached at the top of the encasement to provide a trampoline spring mat.

11 Claims, 2 Drawing Figures

FLOTATION TRAMPOLINE

BACKGROUND OF THE INVENTION

1. Field of the Invention

This invention relates to a trampoline for use on a swimming pool, lake or other similar body of water. More particuarly, the subject invention pertains to a flotation trampoline adapted for stable use on a water surface.

2. Prior Art

Trampoline devices are well known in sports and athletic fields. Generally, a trampoline consists of a sheet of canvas attached by resilient cords or springs to a horizontal frame several feet above the floor. Traditionally such devices have been used by acrobats and gymnasts as a spring board in tumbling activities. More recently, smaller trampoline devices have been developed for exercise techniques such as jogging.

Trampolines have characteristically been used on a solid floor base or in a ground mounted configuration. This has been required in view of the large forces which are applied to the canvas and rigid support as a person bounces and impacts the resilient canvas surface. Without the solid floor or ground for support, the trampoline would be unable to resist the force of impact of the user.

Intuitively, the efficiency of a trampoline depends in part on its ability to retain the energy of impact as the user jumps on the canvas, and store that energy for rebound. If the energy is dissipated to any significant degree, the ability of the trampoline to operate is significantly impaired. Positioning the trampoline on a hard surface minimizes the amount of energy transferred through the rigid frame and thereby enhances the efficiency of the trampoline to provide increasing rebound lift as the user jumps higher with each successive bounce.

Pneumatic trampoline devices have been developed which rely totally upon the use of a hard surface. An example of such a trampoline is U.S Pat. No. 3,130,816 by H. B. Wright. It discloses a trampoline which utilizes the collapsable response of an inner tube to provide lift in response to each bounce. Its operation depends upon the ability of the pneumatic tube to expand or balloon during impact, and thereby store this energy for subsequent rebound.

In attempting to develop the same efficiency in a flotation type trampoline, it will be apparent that serious problems will be encountered. First, a stable platform capable of floating in a water surface must be developed which is capable of retaining stability despite extreme impacts which occur during use. Because of the low friction factor at the water surface, energy dissipation can occur in multiple directions. The most obvious direction of energy loss is along the vertical line of movement of the user. For example, as the person jumping on the trampoline impacts the canvas mat, the trampoline is driven deeper in the water. If the trampoline mat is supported underneath by a conventional innertube, the impact of the user drives water up through the opening of the innertube. This not only dissipates rebound energy of the trampoline, but also lowers the distance of free movement between the water surface and trampoline mat. The consequence is that a trampoline support on an innertube is virtually non-functional because the displacement of water at impact absorbs most of the impacting force.

In addition to the difficulty of maintaining vertical stability for a flotation trampoline, lateral stability is difficult to maintain. If the impact of the user at the trampoline is off center, the force applied to the floating support is non-uniform. In such circumstances, the floating support will move in the direction of lateral force. The consequence is that as the user jumps on the trampoline and impacts off center, the trampoline slides over the water surface, out of alignment with the user. As a consequence, a flotation trampoline may allow one jump for the user before going out of position and being useless as far as repeated jumping is concerned.

In view of the foregoing problems, flotation trampolines have not previously been designed for repeated jumping. Instead, such trampolines function merely as diving boards positioned on the water surface. Their use consists of a single jump or bounce.

A further problem with a pneumatic type of trampoline arises from the collapsible nature of the innertube structure which is designed to provide the resilience for jumping movement. As the user impacts off center on any portion of the trampoline, the non-uniform distribution of the force over the supporting tube results in differential expansion of the tube. In other words, one portion of the tube will become more greatly enlarged, forcing the tube to move laterally in the direction of lesser expansion. Such lateral movement is the by product of the attempt of the tube to establish itself to a horizontal level in the water. Here again, lateral movement of the tube permits one bounce on the user before the tube is displaced out of the vertical direction of movement.

What is needed, therefore, is a flotation trampoline which is capable of maintaining a stable platform during repeated jumping movement, while at the same time preventing dissipation of force in either vertical or lateral directions.

OBJECTS AND SUMMARY OF THE INVENTION

It is the object of the present invention to provide a flotation trampoline which allows sequential jumping at the trampoline surface without signficant lateral displacement of the trampoline.

It is the further object of the present invention to provide a flotation trampoline which preserves impact energy for the rebound of the jumper, as opposed to dissipation of such force into the water.

It is a still further object of the present invention to provide a flotation trampoline which maintains a uniform cross section, despite the non-uniform application of force during jumping activity.

It is a still further object of this invention to provide such a trampoline which is adapted for other water activities ancillary to its primary use as a trampoline surface.

These and other objects are realized in a flotation trampoline which comprises a non-elastic, collapsible encasement having a symmetrical configuration resembling an innertube. This encasement has a lower, interior tube surface which extends from the inner most perimeter of the tube opening and preferentially below this perimeter down to a second perimeter defined by the point of contact of water at the lower tube surface when the tube is floating on a still body of water. The encasement is supported by an inflatable tube contained therein which is adapted to expand to the full volume of the encasement structure. A valve is provided to introduce and remove air from the encased tube. A base cover is attached at the lower, interior tube surface to seal off rapid air flow through the tube opening and create a substantially closed volume between the base cover, lower interior tube surface and the water surface upon which the tube is placed. A trampoline or other form of resilient cover is attached at the top of the tube opening and provided with springs or bands to operate as a trampoline.

The subject invention provides a stable, trampoline device which can be positioned on a water surface and utilized in repeated jumping activities in much the same manner as a ground-mounted trampoline. The non-elastic structure of the encasement prevents the enclosed tube from expanding or contracting in a non-uniform manner. Accordingly, a person jumping on this trampoline can impact off center without causing the trampoline to slide out of place. The base cover prevents the tube from submerging on impact and also provides a form of vacuum suction which further stabilizes the flotation trampoline in place.

These and other benefits of the subject invention will be better understood in view of the following detailed description, when taken in combination with the attached drawings, wherein:

FIG. 1: Represents a perspective view of the subject flotation trampoline with a partially cut away trampoline mat to reveal the interior base cover and construction of the device.

FIG. 2: Represents a cross section taken along the lines 2—2, and further providing illustration of contact at a water surface.

DETAILED DESCRIPTION OF THE INVENTION

Figure 1:
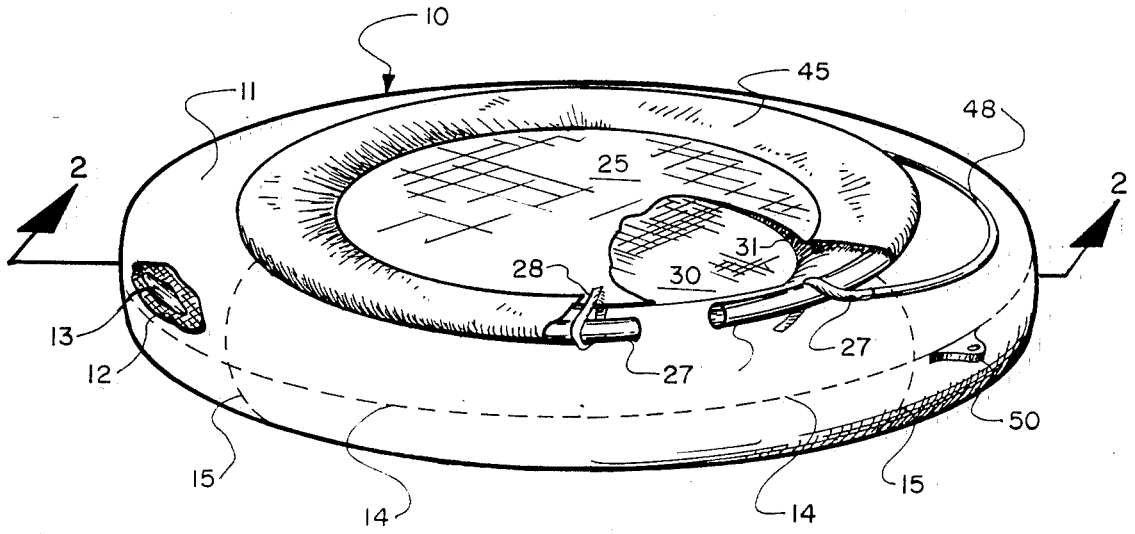

One embodiment of the subject flotation trampoline 10 comprises a non-elastic, collapsible encasement 11. This encasement is fabricated out of vinyl or a similar plastic which is well suited for continued use in water. The vinyl material is reinforced with a woven fabric 12 to provide strength and prevent elastic response of the vinyl material.

This encasement 11 encloses an inflatable tube for support means 13 which is adapted to expand to and support the expanded shape of the encasement as shown in the figures. This tube may be an innertube for a large truck tire or may be fabricated expressly for use as part of a flotation trampoline. The tube is filled by introduction of air through a valve 20 (FIG. 2) which may also be used to deflate the innertube to permit storage of the device in a limited space.

When the encasement 11 is fully expanded by inflation of the innertube 13, its structure has a symmetrical configuration resembling that of the innertube. Such symmetry is important for maintenance of the flotation trampoline in vertical alignment with the user as he repeatedly jumps at the trampoline surface 25. During impact as the person lands on the trampoline 25 or encasement 11, such symmetry is maintained by the non-elastic response developed in the encasement material by virtue of encapsulated fabric 12 which prevents elongation or ballooning of the tube. As has been previously indicated, if the innertube 13 were permitted to balloon or enlarge at any given location during impact, its boyancy would tend to displace the tube and attached trampoline along the direction toward the minimum tube radius. Use of the non-elastic encasement establishes the maximum radius R along the inflated tubular structure. Accordingly, although the encasement 11 and enclosed tube 13 may collapse under impact, such collapse does not result in a corresponding increase in dimension at the remaining portions of the tube. Accordingly, lateral displacement is minimized.

Although an annular shape having a circular cross section is shown (FIG. 2) it will be understood by those skilled in the art that other cross sections may be substituted. The circular cross section was selected because of ease of manufacturer. Likewise, the symmetry referenced above is not to be construed as limiting the subject invention to circular shapes. The provision of symmetry is primarily for practical considerations designed to keep the flotation trampoline in line with the vertical jumping orientation of the user. Non-symmetrical configurations would be more likely to result in lateral shifting of the trampoline.

The subject flotation trampoline is further stabilized by use of a base cover 30 which is attached to the lower side of the encasement 11 at seam 31. This seam is described hereafter as the perimeter of the base cover 30. Although the position of this perimeter along the interior surface 32 will vary, it has been discovered that the flotation trampoline is only operational if the base cover 30 is attached at a limited area of the tube opening. This area is defined hereafter as the lower, interior tube surface.

Generally, this surface comprises the external surface area on the encasement 11 which extends from the inner most perimeter from the tube opening 35 (shown by dashed line 35*a*) and preferably below this line and above a second, lower perimeter 36. This lower perimeter occurs on the lower tube surface at the inner most locus of contacts which would occur with water when the fully inflated tube is positioned on a still water surface 40.

The base cover perimeter 31 lies between the inner most perimeter 35 and the lower perimeter 36. Therefore, the base cover 30 is positioned above the water surface 40 and below the inner most perimeter of the tube 35*a*. This base cover 30 is attached or otherwise sealed at its perimeter 31 on the lower, interior tube surface and is adapted to seal off any rapid air flow which might otherwise occur through the tube opening.

The use of the base cover 30 not only prevents water from surging up through the tube opening upon impact by a person jumping on the trampoline, but it also defines a substantially closed volume which developes a suction effect to keep the tube in position at the water surface. This closed volume is defined at its top by the base cover, at its bottom by the water surface and around its periphery by the lower interior tube surface. Suction is developed as the user jumps on the trampoline, driving the tube slightly into the water thereby reducing the closed volume under the base cover. As the user rebounds free of the trampoline, the boyancy of the innertube lifts the encasement and base cover upward, creating a partial vacuum in the closed volume. As a consequence, the flotation trampoline is retained at the water surface in proper alignment for repeated bouncing by the user.

This base cover may be fabricated from the same type of fabric reinforced vinyl as was used for the encasement 11, or it may be of any other material which satisfies the requirements of blocking the flow of air or water, along with establishing a partial vacuum under the flotation trampoline. If the base cover comprises fiber reinforced plastic material such as used in the encasement, fabrication procedures simply involve sewing the cover at the referenced perimeter 31. Other seams have been illustrated for the encasement as items 14 and 15.

Figure 2:
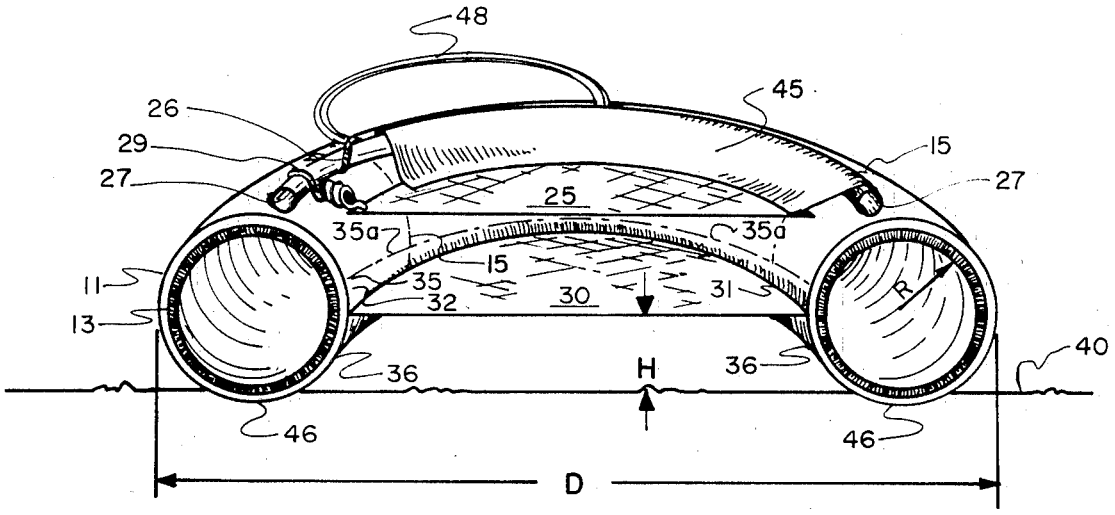

The trampoline mat 35 may be attached at the top of the encasement 11 by numerous methods. Straps 26 have been illustrated as merely one example of means for attaching the trampoline mat 25 in proper position. Where the trampoline mat includes a rigid ring 27, the straps 26 can be fastened directly on the ring 27 to retain it at the upper surface of the encasement 11. The figures illustrate the attachment of the mat 25 to the ring 27 by way of rubber strands 28 which provide the elastic response to the trampoline for proper bouncing motion. It will be apparent to those skilled in the art that springs could be substituted for strands 28 to develop a similar effect. This substitution is shown in FIG. 2 by item 29 which is a spring element instead of the rubber strand 28 illustrated in FIG. 1. In each instance, the strand or spring provides the tension to the mat to establish trampoline response. A padded cover 45 protects the user from impacting the rigid ring 27 which may be fabricated of plastics or metal. It should therefore be apparent that the subject flotation trampoline is not a pneumatic type trampoline, inasmuch as the trampoline action is developed by the strands 28 or springs 29 attached to the jumping mat 25.

It has been found that the subject trampoline provides unusually surprising rebound action during trampoline use. The elastic jumping mat 25 mounted on the described encasement 11 developes surprising resilience for repeated jumping to succesive higher distances. Because of the surprising performance, it has been found preferable to have a encasement diameter D of at least three feet and preferably five to six feet in diameter. For proper trampoline response, the diameter of the rigid ring 27 should be at least two feet, and preferably three to four feet in diameter. Tube radius R should be sufficient to maintain the flotation trampoline high on the water surface, as illustrated in the figures. A tube radius of approximately six inches has been found adequate for this purpose. The height H of the base cover 30 above water surface level 40 should be sufficient to develop suction effect during trampoline action. It has been found that the base cover perimeter 31 should be at least two inches above the base 46 of the encasement, and preferably approximately three inches in height.

It will be apparent to those skilled in the art that the dimensions as well as the materials of fabrication set forth in the detailed description may be subject to substantial variation while remaining within the concepts of the subject invention. Accordingly, such dimensions and material descriptions are not intended to be restricting except as they may be set forth in the following claims.

Because of the many utilities of the flotation trampoline in water sports, the figures disclose the use of a safety cord 48 which is attached at straps 26 to enable users to pull themselves up on the trampoline from the water. In addition, a tab 50 is attached to the encasement 11 to provide means for coupling of a tether line to the trampoline so that it can be secured to a dock, boat or underwater anchor. It will also be apparent to those skilled in the art that the specific applications of the flotation trampoline described herein are not to be considered restrictive, and that other applications are clearly foreseeable. Accordingly, the scope of the subject invention is to be ascertained from the attached claims and is not to be limited by the foregoing detailed description.

I claim:

1. A flotation trampoline adapted for use on a body of water, comprising:

a non-elastic, collapsible encasement having a symmetrical configuration resembling an innertube when fully expanded and which includes a lower, interior tube surface commencing at the innermost perimeter of the tube opening and continuing downward to a second perimeter occuring on the lower tube surface at the innermost locus of contacts which would occur with water when the fully inflated tube is positioned on a still water surface, said tube having a diameter of at least three feet;

inflatable support means contained within the encasement and adapted with means for receiving air therein to expand and support the collapsible encasement;

a base cover attached and sealed at a perimeter on the lower, interior tube surface to seal off rapid air flow through the tube opening to the base of the tube to thereby create a substantially closed volume between the base cover, lower interior tube surface and a water surface upon which the tube is placed; and a resilient, trampoline mat positioned over the tube opening near the top of the tube encasement and attached to the encasement and displayed above said base cover thereby defining a second closed volume for use as a trampoline jumping surface.

2. A flotation trampoline as defined in claim 1, wherein the encasement is fabricated of fiber-reinforced plastic material which is flexible, yet strong enough to support the weight of a fifty pound individual jumping directly on the inflated encasement.

3. A flotation trampoline as defined in claim 2, wherein the plastic comprises a vinyl polymer formed directly on a woven fabric reinforcement substrate.

4. A flotation trampoline as defined in claim 1, wherein the base cover is fabricated of fiber-reinforced plastic material, said cover being attached to the encasement below the innermost perimeter of the interior tube surface to block air and water flow through the tube opening.

5. A flotation trampoline as defined in claim 4 wherein the base cover is sewn to the encasement below the innermost perimeter of the interior tube surface and is located at least two inches above the base of the expanded encasement.

6. A flotation trampoline as defined in claim 5, wherein the perimeter is located at approximately three inches above the base of the expanded encasement.

7. A flotation trampoline as defined in claim 1, wherein the trampoline spring mat is supported in tension on a rigid ring having a diameter of at least two feet, said ring being adapted for attachment to a top portion of the encasement.

8. A flotation trampoline as defined in claim 7, wherein the means for applying tension to the mat comprises springs coupled between the mat perimeter and the ring.

9. A flotation trampoline as defined in claim 7, wherein the means for applying tension to the mat comprises elastic strands coupled between the mat perimeter and the ring.

10. A flotation trampoline as defined in claim 1, further comprising means for attaching a tether line near the most extreme perimeter of the encasement.

11. A flotation trampoline as defined in claim 8, further comprising protective padding over the perimeter of the ring to prevent injurious contact with a person jumping on the trampoline.

* * * * *